US012722668B2

(12) United States Patent
Hoerlendsberger et al.

(10) Patent No.: US 12,722,668 B2
(45) Date of Patent: Sep. 1, 2026

(54) FIXING DEVICE AND METHOD FOR FIXING A WINDOW PANE OF A WINDOW FOR A RAIL VEHICLE AND WINDOW FOR A RAIL VEHICLE

(71) Applicant: KNORR-BREMSE GESELLSCHAFT MIT BESCHRAENKTER HAFTUNG, Moedling (AT)

(72) Inventors: Christian Hoerlendsberger, Waldhofen an der Ybb (AT); Petr Uttendorsky, Moedling (AT); Michal Vik, Moedling (AT); Milos Malec, Moedling (AT); David Sacha, Moedling (AT); Milan Hasak, Moedling (AT)

(73) Assignee: KNORR-BREMSE GESELLSCHAFT MIT BESCHRANKTER HAFTUNG, Moedling (AT)

( * ) Notice: Subject to any disclaimer, the term of this patent is extended or adjusted under 35 U.S.C. 154(b) by 124 days.

(21) Appl. No.: 18/935,440

(22) Filed: Nov. 2, 2024

(65) Prior Publication Data

US 2025/0136156 A1 May 1, 2025

Related U.S. Application Data

(63) Continuation of application No. PCT/EP2023/061607, filed on May 3, 2023.

(30) Foreign Application Priority Data

May 4, 2022 (DE) ..... 102022111000.1

(51) Int. Cl.
*B61D 25/00* (2006.01)

(52) U.S. Cl.
CPC ..... *B61D 25/00* (2013.01)

(58) Field of Classification Search
CPC ..... B60J 1/004; B60J 1/006; B60J 1/10; B60J 1/70; B60J 1/30; E06B 3/66328;
(Continued)

(56) References Cited

U.S. PATENT DOCUMENTS 4,497,516 A * 2/1985 Morita ..... B60J 10/30 296/206
4,640,066 A * 2/1987 Hayashi ..... B60J 10/265 52/204.597
(Continued)

FOREIGN PATENT DOCUMENTS

DE 3040592 A1 9/1982
DE 102013204992 A1 * 9/2014 ..... B60J 10/365
(Continued)

*Primary Examiner* — Jessica L Laux
(74) *Attorney, Agent, or Firm* — Von Rohrscheidt Patents

(57) ABSTRACT

A fixing device configured to fix a window pane of a window in a door leaf of a rail vehicle, the fixing device including a profile element; a window profile element; and a fastening device, wherein the fastening device is configured to fasten the profile element and the window profile element at each other by positive form locking and/or friction locking, wherein the profile element is formed from an elastic material, wherein the profile element includes a recess portion configured to fit around a border region of the window pane, a mounting portion configured to mount a first part of the fastening device on the profile element by positive form locking, a cover portion configured to cover the fastening device, and a connection portion configured to connect the cover portion to the window profile element by positive form locking.

10 Claims, 2 Drawing Sheets

(58) Field of Classification Search
CPC ..... E06B 3/5454; E06B 3/5481; E06B 3/56; E06B 3/58; E06B 3/5807; E06B 3/5821; E06B 3/5892; E06B 3/62; E06B 2003/6258; B61D 25/00
See application file for complete search history.

(56) References Cited

U.S. PATENT DOCUMENTS

| | | | | |
|---|---|---|---|---|
| 4,703,973 | A * | 11/1987 | Fujikawa | B60J 10/30 52/716.6 |
| 11,591,845 | B2 * | 2/2023 | Roesner | E06B 3/70 |
| 2003/0070371 | A1 * | 4/2003 | Kobrehel | E06B 3/62 52/204.5 |
| 2014/0290529 | A1 | 10/2014 | Tazreiter | |
| 2023/0332458 | A1 * | 10/2023 | Lee | E06B 3/5892 |

FOREIGN PATENT DOCUMENTS

| | | | | |
|---|---|---|---|---|
| EP | 0895890 | A1 | 2/1999 | |
| EP | 3604009 | A1 | 2/2020 | |
| WO | WO-2013072343 | A1 * | 5/2013 | B61D 25/00 |

* cited by examiner

FIXING DEVICE AND METHOD FOR FIXING A WINDOW PANE OF A WINDOW FOR A RAIL VEHICLE AND WINDOW FOR A RAIL VEHICLE

RELATED APPLICATIONS

This application is a continuation of international patent application PCT/EP2023/061607 filed on May 3, 2023, claiming priority from German patent application DE 10 2022 111 000.1, both of which are incorporated in their entirety by this reference.

FIELD OF THE INVENTION

The invention relates to a fixing device for fixing a window pane of a window in a door leaf for a rail vehicle, to a window for a rail vehicle and to a method for fixing a window pane of a window in a door leaf for a rail vehicle by means of a fixing device of this kind.

BACKGROUND OF THE INVENTION

There may be special requirements, for example, for fixing window panes in door leaves of rail vehicles. In conventional practice, a window pane can be fixed in a window of a rail vehicle, in particular, by adhesive or just by means of a rubber profile. The use of some other adhesive, e.g. one with a shorter curing time, would also be conceivable, for example.

BRIEF SUMMARY OF THE INVENTION

Given this background, it is the object of the present invention to provide an improved fixing device for fixing a window pane of a window in a door leaf for a rail vehicle, an improved window for a rail vehicle and an improved method for fixing a window pane of a window in a door leaf for a rail vehicle by means of a fixing device of this kind.

This object is achieved by a fixing device for fixing a window pane of a window in a door leaf for a rail vehicle, by a window for a rail vehicle and by a method for fixing a window pane of a window in a door leaf for a rail vehicle by means of a fixing device of this kind according to the independent claims.

According to embodiments, it is possible, in particular, to achieve fixing of a window pane in a door leaf for a rail vehicle in a profile element, e.g. a rubber profile, by means of a fastening device, e.g. by means of at least one screw. In other words, window pane installation or fixing can be implemented, in particular, by using conventional processes to replace special processes, e.g. adhesive bonding, or to replace disadvantageous methods. Such installation or fixing of window panes in door leaves for rail vehicles can also, in particular, enable implementation by series production. To fix a window pane of a window in a door leaf for a rail vehicle, it is thus possible, according to embodiments, to dispense with adhesive or other adhesive bonding means, for example, and thus with integrally connected joints. Here, the fastening device, e.g. at least one fixing screw, can be covered by a profile element, in particular a rubber fixing profile, of the fixing device itself and can thus be invisible to passengers of the rail vehicle.

According to embodiments, it is advantageously possible, in particular, to shorten an installation time, to improve protection against vandalism and to enable rapid exchangeability of the window pane directly in the rail vehicle. As compared with fixing by integral connection, such adhesive-free fixing of the window pane or fixing without integral connection, can also lead, for example, according to embodiments, to the advantageous elimination of certification of the adhesive bonding process for rail operations and a curing time for adhesive, thus enabling rapid and easy exchangeability of the window pane directly on the rail vehicle. As compared with fixing just by a rubber profile, it is possible by combined fixing according to embodiments, in particular, to obtain a level or flush surface after fixing, it being possible to avoid a situation where a rubber profile protrudes from the assembly surface, and to achieve exchangeability of the window pane directly on the rail vehicle.

The disclosure presents a fixing device for fixing a window pane of a window in a door leaf for a rail vehicle, wherein the fixing device has a profile element, a window profile element and a fastening device, wherein the fastening device is designed to fasten the profile element and the window profile element to each other by positive engagement and additionally or alternatively by nonpositive engagement, wherein the profile element is formed from an elastic material, wherein the profile element has a recess portion for fitting around a border region of the window pane, a mounting portion for mounting one part of the fastening device on the profile element by positive engagement, a cover portion for covering the fastening device, and a connection portion for connecting the cover portion to the window profile element by positive engagement, wherein the cover portion is arranged between the mounting portion and the connection portion, wherein the window profile element has an arrangement portion for arranging another part of the fastening device and a receiving portion for receiving the connection portion of the profile element.

The profile element may also be referred to as a fixing profile or rubber fixing profile. The window profile element may also be referred to as a window profile. Fitting around can represent a connection by positive engagement. Arrangement can represent a connection by positive engagement. The cover portion and the connection portion of the profile element can be capable of bending relative to the recess portion and the mounting portion of the profile element to make the fastening device accessible. The recess portion, the mounting portion and the cover portion of the profile element can extend along and, additionally or alternatively, parallel to a main plane of extent of the window pane. In other words, the recess portion, the mounting portion and the cover portion of the profile element can extend parallel to a common component plane. The connection portion can extend transversely to the main plane of extent of the window pane and, additionally or alternatively, to the common component plane. The window profile element can be connectable or connected to a wall, surrounding the window, of a door leaf for the rail vehicle.

According to one embodiment, the profile element can be formed in one piece and, additionally or alternatively, from rubber. Such an embodiment offers the advantage that a robust and reliable profile element can be produced at low cost, e.g. by extrusion.

Moreover, the fastening device can have at least one fixing plate, at least one thread device and at least one fixing screw. Here, the at least one thread device can be capable of being arranged on the arrangement portion of the window profile element. In this case, the at least one fixing plate can be mountable in the mounting portion of the profile element and can be capable of being fastened on the window profile element by means of the at least one thread device and the at least one fixing screw. The at least one fixing plate can represent one part of the fastening device. The at least one thread device and, optionally in addition, the at least one fixing screw can represent the other part of the fastening device. At least one thread device and at least one fixing screw can be provided for each fixing plate. The thread device can be a riveting nut, a thread, a threaded insert or the like. Such an embodiment offers the advantage that fastening of the profile element and of the window profile element to one another can be enabled in a robust, reliable and easily releasable manner by positive engagement and, additionally or alternatively, nonpositive engagement.

In a state in which the profile element and the window profile element are fastened to one another, the cover portion of the profile element can furthermore be arranged flush with a bezel portion of the window profile element. Here, the bezel portion can be arranged adjacent to the receiving portion. The receiving portion can be arranged between the bezel portion and the arrangement portion. In a state in which the profile element and the window profile element are fastened to one another, the cover portion can thus advantageously form a plane or a flush surface with a bezel portion of the window profile element when the connection portion is received in the receiving portion.

Moreover, the window profile element can have an outer bearing portion for bearing against an outer panel of a wall, surrounding the window, of the door leaf for the rail vehicle, and an inner bearing portion for bearing against an inner panel of the wall, surrounding the window, of the door leaf for the rail vehicle. The bearing portions can be arranged on mutually opposite sides of the window profile element. In this case, the outer panel can face an environment of the rail vehicle. The inner panel can face an interior or passenger zone of the rail vehicle. Such an embodiment offers the advantage that the window profile element and thus the fixing device can be connected easily and precisely to the wall, surrounding the window, of the door leaf for the rail vehicle.

In this case, each of the bearing portions can be formed as a step-shaped recess with a bearing surface and an abutting edge portion. Here, a step height of the abutting edge portion can correspond to a thickness of the respective panel of the wall, surrounding the window, of the door leaf for the rail vehicle. Such an embodiment offers the advantage that the outer panel and the window profile element can form a level surface relative to an outer side of the rail vehicle, and the inner panel, the window profile element, to be more precise the bezel portion and the profile element, can form a level surface relative to an inner side of the rail vehicle.

According to one embodiment, adjacent to the receiving portion, the window profile element can have a recess for the positive retention of the connection portion of the profile element. The recess can be arranged between the receiving portion and a bezel portion of the window profile element. Such an embodiment offers the advantage that the connection portion can be retained in a simple and reliable manner.

In the recess portion, the profile element can also have a plurality of ribs for bearing against the border region of the window pane. Such an embodiment offers the advantage that the border region of the window pane can be reliably retained.

In addition, a window for a rail vehicle is presented, wherein the window can have a window pane and at least one example of an embodiment of a fixing device mentioned herein.

Using an embodiment of a fixing device mentioned herein, the window pane can thus be fixed in an advantageous manner in a door leaf.

A method for fixing a window pane of a window in a door leaf for a rail vehicle by means of an embodiment of a fixing device mentioned herein is furthermore presented, wherein the method has the following steps:

- arranging the border region of the window pane in the recess portion of the profile element, wherein the recess portion fits around the border region;
- mounting one part of the fastening device in the mounting portion of the profile element by positive engagement;
- arranging the other part of the fastening device in the arrangement portion of the window profile element;
- fastening the profile element and the window profile element on one another by positive engagement and/or nonpositive engagement by means of the fastening device; and
- connecting the cover portion of the profile element to the window profile element by positive engagement, wherein the connection portion of the profile element is received in the receiving portion of the window profile element.

By carrying out the method, a window pane of a window can be fixed in an advantageous manner in a door leaf for a rail vehicle using an embodiment of a fixing device mentioned herein. In this process, the step of arrangement, the step of mounting and the step of arrangement can be carried out in any desired sequence relative to one another. The step of arrangement, the step of mounting and the step of arrangement can be carried out before the step of fastening and the step of connection. The step of fastening can be carried out before the step of connection. The step of connection can be carried out after the step of fastening.

BRIEF DESCRIPTION OF THE DRAWINGS

Advantageous embodiments of the invention are now describe in greater detail with reference to drawing figures, wherein.

DETAILED DESCRIPTION

Figure 1:
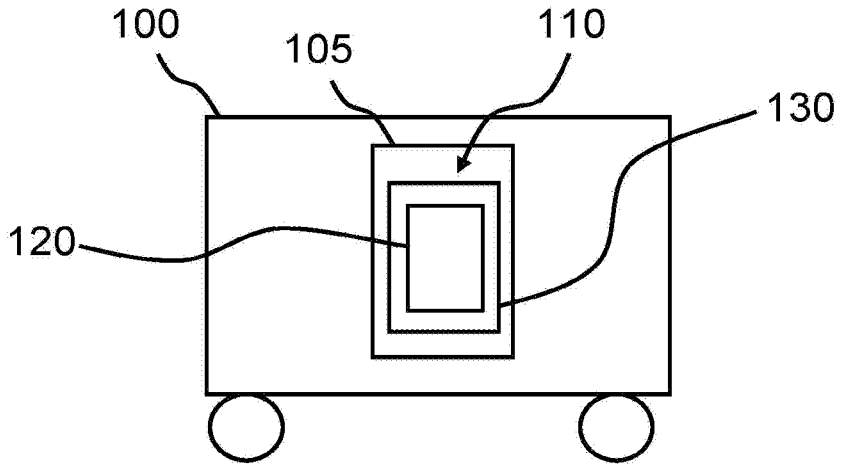
FIG. 1 shows a schematic illustration of a rail vehicle with an exemplary embodiment of a window.

FIG. 1 shows a schematic illustration of a rail vehicle 100 with an exemplary embodiment of a window 110 in a door leaf 105. The rail vehicle 100 can have at least one such window 110. The window 110 comprises a window pane 120 and a fixing device 130. The fixing device 130 is designed to fix the window pane 120 of the window 110 in the door leaf 105. Further details of the fixing device 130 are given below with reference to the following figures.

Figure 2:
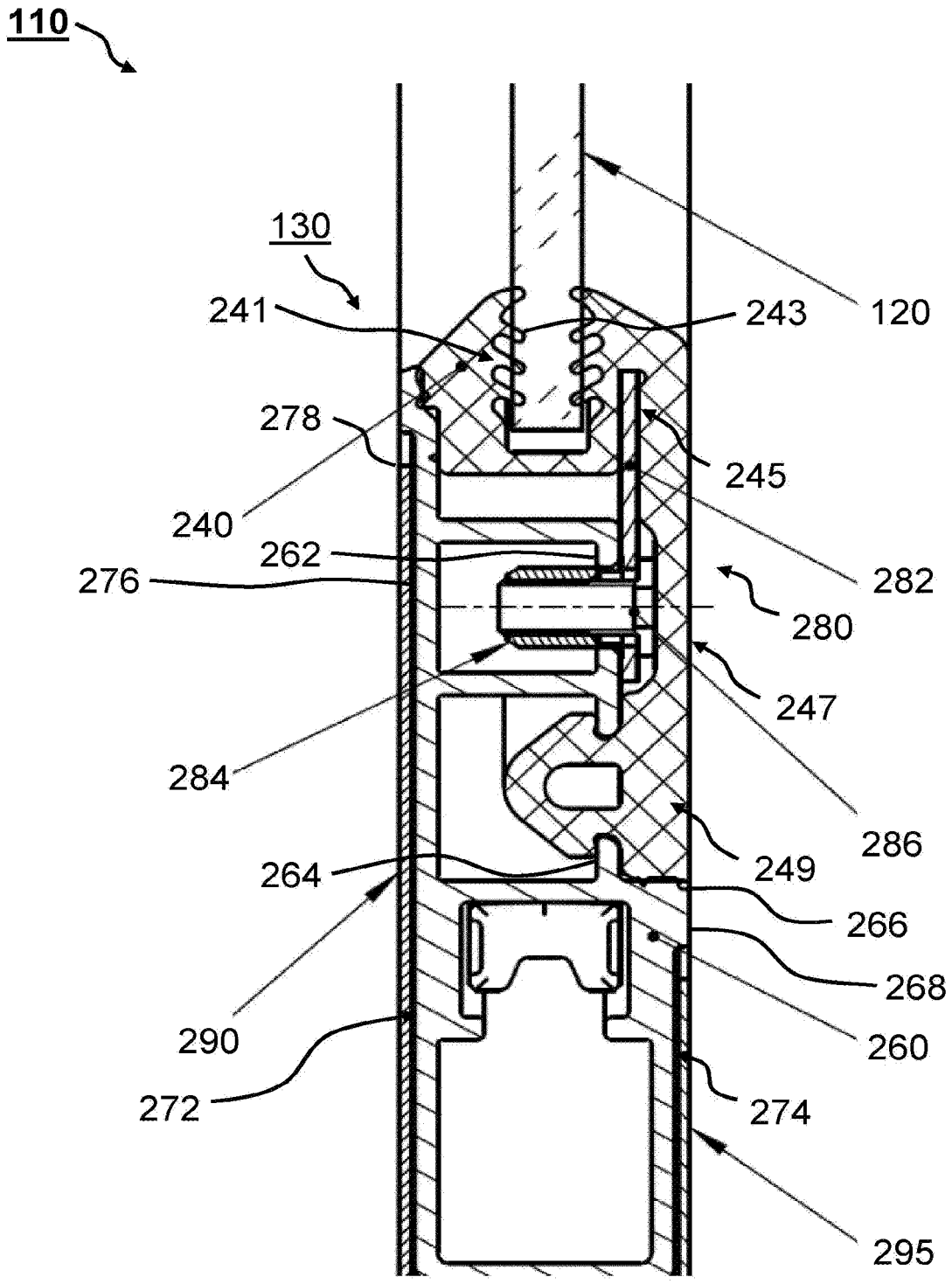
FIG. 2 shows a schematic partial illustration of an exemplary embodiment of a window for a rail vehicle.

FIG. 2 shows a schematic partial illustration of an exemplary embodiment of a window 110 for a rail vehicle. The window 110 corresponds to the window from FIG. 1, for example. The window 110 comprises a window pane 120, of which only a partial section is shown, and a fixing device 130.

The fixing device 130 is arranged along at least one side or edge of the window pane 120, or even on all sides or edges of the window pane 120, for example. The fixing device 130 is designed to fix the window pane 120 of the window 110. The fixing device 130 comprises a profile element 240, a window profile element 260 and a fastening device 280.

The profile element 240 is formed from an elastic material. The profile element 240 comprises a recess portion 241, a mounting portion 245, a cover portion 247 and a connection portion 249. The recess portion 241 is formed to fit around a border region of the window pane 120. The border region comprises an edge and an adjoining border of two opposite window surfaces of the window pane. The mounting portion 245 is formed for mounting part of the fastening device 280 on the profile element 240 by positive engagement. The cover portion 247 is formed to cover or conceal the fastening device 280. The connection portion 249 is formed to connect the cover portion 247 to the window profile element 260 by positive engagement. In this case, the cover portion 247 is arranged between the mounting portion 245 and the connection portion 249. The mounting portion 245 is arranged between the recess portion 241 and the cover portion 247.

According to the exemplary embodiment illustrated here, the profile element 240 is formed in one piece. Furthermore, the profile element 240 is made of rubber or from a comparable elastic material. Moreover, the profile element 240 according to the exemplary embodiment illustrated here comprises a plurality of ribs 243. The ribs 243 are arranged in the recess portion 241 and are formed to rest against the border region of the window pane 120.

The window profile element 260 comprises an arrangement portion 262 and a receiving portion 264. The arrangement portion 262 is formed for the arrangement of another part of the fastening device 280, to be more precise arrangement by positive engagement. The receiving portion 264 is formed to receive the connection portion 249 of the profile element 240, to be more precise to receive it by positive engagement.

According to the exemplary embodiment illustrated here, the window profile element 260 furthermore comprises a recess 266, which is arranged adjacent to the receiving portion 264. The recess 266 is formed to retain the connection portion 249 of the profile element 240 by positive engagement. Moreover, the window profile element 260 according to the exemplary embodiment illustrated here comprises an outer bearing portion 272 for bearing against an outer panel 290 of a wall, surrounding the window, of the rail vehicle, in particular of the door leaf, and an inner bearing portion 274 for bearing against an inner panel 295 of the wall, surrounding the window, of the rail vehicle, in particular of the door leaf. The bearing portions 272, 274 are arranged on mutually opposite sides of the window profile element 260. In this case, each of the bearing portions 272, 274 is formed as a step-shaped recess with a bearing surface 276 and an abutting edge portion 278. A step height of the abutting edge portion 278 corresponds to a thickness of the respective panel 290, 292 of the wall, surrounding the window, of the rail vehicle, in particular of the door leaf. Moreover, the window profile element 260 according to the exemplary embodiment illustrated here comprises a bezel portion 268. The bezel portion 268 is arranged between the receiving portion 264 and the inner bearing portion 274. To be more precise, the bezel portion 268 is arranged between the recess 266 and the inner bearing portion 274. In a state in which the profile element 240 and the window profile element 260 are fastened to one another, wherein the connection portion 249 of the profile element 240 is received in the receiving portion 264 of the window profile element 260, the cover portion 247 of the profile element 240 is arranged flush with the bezel portion 268 of the window profile element 260.

The fastening device 280 is designed to fasten the profile element 240 and the window profile element 260 to one another by positive engagement and/or nonpositive engagement.

According to the exemplary embodiment described here, the fastening device 280 comprises at least one fixing plate 282, at least one thread device 284 and at least one fixing screw 286. The at least one fixing plate 282 is mounted in the mounting portion 245 of the profile element 240, to be more precise is clamped in on one side. The at least one thread device 284, in this case a riveting nut, is arranged on the arrangement portion 262 of the window profile element 260, to be more precise arranged in such a way as to bear against the latter. The at least one fixing plate 282 is furthermore fastened on the window profile element 260 by means of the at least one thread device 284 and the at least one fixing screw 286. In this case, the at least one fixing screw 286 engages through a through opening in the at least one fixing plate 282 into the at least one thread device 284, here embodied as a riveting nut. In this case, the arrangement portion 262 of the window profile element 260 is clamped between the at least one thread device 284, on the one hand, and the at least one fixing plate 282 as well as a head of the at least one fixing screw 286, on the other hand.

It is furthermore evident from the illustration in FIG. 2 that the recess portion 241 is formed as a groove, a slot or the like. The window pane 120 is arranged by means of its border region in the recess portion 241. The recess portion 241 is furthermore arranged between the mounting portion 245 and a supporting portion, by means of which the profile element 240 rests on the window profile element 260. The mounting portion 245 is formed as a slot. A partial section of the fixing plate 282 is mounted in the mounting portion 245. The cover portion 247 spans the fastening device 280, in particular the thread device 284 and the fixing screw 286, between the mounting portion 245 and the connection portion 249. The connection portion 249 is arrow-shaped, hook-shaped or latching-nose-shaped. The receiving portion 264 is formed to retain the connection portion 249 at the narrowest point of the latter. The bearing surface 276 of the outer bearing portion 272 is larger than the bearing surface of the inner bearing portion 274 in order to take account of different dimensions of the panels 290 and 295. The outer panel 290 extends to the height of the recess portion 241, wherein the inner panel 295 extends only to the height of the bezel portion 268.

Figure 3:
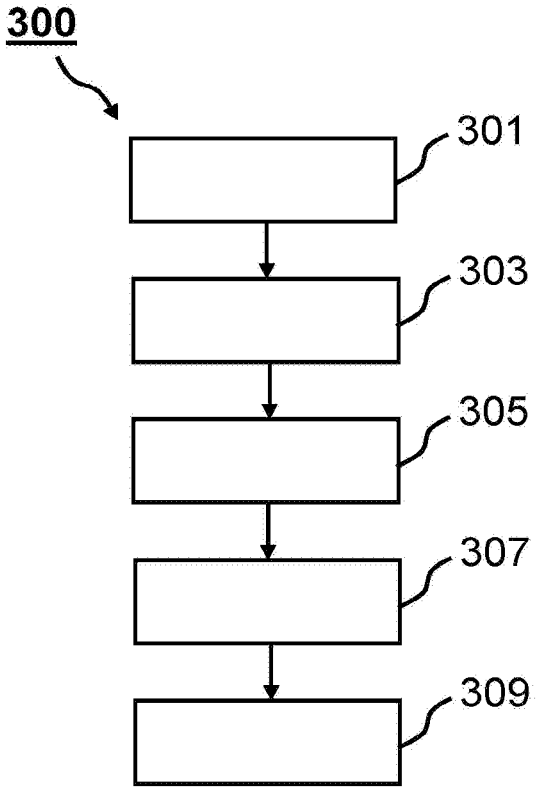
FIG. 3 shows a flow diagram of an exemplary embodiment of a method for fixing a window pane of a window for a rail vehicle.

FIG. 3 shows a flow diagram of an exemplary embodiment of a method 300 for fixing a window pane of a window in a door leaf for a rail vehicle. Here, the method 300 for fixing can be carried out by means of or using a fixing device that corresponds to or resembles the fixing device from one of the figures described above. The method 300 for fixing comprises a step 301 of arrangement, a step 303 of mounting, a step 305 of arrangement, a step 307 of fastening, and a step 309 of connection.

In the step 301 of arrangement, the border region of the window pane is arranged in the recess portion of the profile element. Here, the recess portion fits around the border region. In the step 303 of insertion, one part of the fastening device is mounted in the mounting portion of the profile element by positive engagement. In the step 305 of arrangement, the other part of the fastening device is arranged in the arrangement portion of the window profile element.

In particular, the step 301 of arrangement, the step 303 of mounting and the step 305 of arrangement can be carried out in any desired or suitable sequence.

In the step 307 of fastening, the profile element and the window profile element are then fastened to one another by positive engagement and/or nonpositive engagement by means of the fastening device. Following this in turn, the cover portion of the profile element is connected to the window profile element by positive engagement in the step 309 of connection. During this process, the connection portion of the profile element is received in the receiving portion of the window profile element.

According to one exemplary embodiment, it is possible in the step 307 of fastening to use a fastening device which has at least one fixing plate, at least one thread device and at least one fixing screw. During this process, the at least one thread device is arranged on the arrangement portion of the window profile element, the at least one fixing plate is mounted in the mounting portion of the profile element and fastened to the window profile element by means of the at least one thread device and the at least one fixing screw.

REFERENCE NUMERALS AND DESIGNATIONS

100 rail vehicle
105 door leaf
110 window
120 window pane
130 fixing device
240 profile element
241 recess portion
243 rib
245 mounting portion
247 cover portion
249 connection portion
260 window profile element
262 arrangement portion
264 receiving portion
266 recess
268 bezel portion
272 outer bearing portion
274 inner bearing portion
276 bearing surface
278 abutting edge portion
280 fastening device
282 fixing plate
284 thread device
286 fixing screw
290 outer panel
295 inner panel
300 method for fixing
301 step of arrangement
303 step of mounting
305 step of arrangement
307 step of fastening
309 step of connection

What is claimed is:

1. A fixing device configured to fix a window pane of a window in a door leaf of a rail vehicle, the fixing device comprising:

a profile element;

a window profile element; and a fastening device, wherein the fastening device is configured to fasten the profile element and the window profile element at each other by positive form locking and/or friction locking, wherein the profile element is formed from an elastic material, wherein the profile element includes a recess portion configured to fit around a border region of the window pane, a mounting portion configured to mount a first part of the fastening device at the profile element by positive form locking, a cover portion configured to cover the fastening device, and a connection portion configured to connect the cover portion to the window profile element by positive form locking, wherein the cover portion is arranged between the mounting portion and the connection portion, wherein the window profile element includes an arrangement portion configured to arrange a second part of the fastening device and a receiving portion configured to receive the connection portion of the profile element.

2. The fixing device according to claim 1, wherein the profile element is integrally formed from one piece and/or from rubber.

3. The fixing device according to claim 1, wherein the fastening device includes at least one fixing plate configured as the first part, at least one threaded device configured as the second part, and at least one fixing screw, wherein the at least one threaded device is arrangeable at the arrangement portion of the window profile element, wherein the at least one fixing plate is mountable in the mounting portion of the profile element and fixable on the window profile element through the at least one threaded device and the at least one fixing screw.

4. The fixing device according to claim 1, wherein the cover portion of the profile element is arranged flush with a bezel portion of the window profile element when the profile element and the window profile element are fastened at one another.

5. The fixing device according to claim 1, wherein the window profile element includes an outer bearing portion that contacts an outer panel of a wall surrounding the window of the door leaf for the rail vehicle, and an inner bearing portion that contacts an inner panel of the wall surrounding the window of the door leaf for the rail vehicle, wherein the inner bearing portion and the outer bearing portion are arranged on opposite sides of the window profile element.

6. The fixing device according to claim 5, wherein the inner bearing portion and the outer bearing portion is formed respectively as a step-shaped recess including a bearing surface and an abutting edge portion, and wherein a step height of the abutting edge portion respectively corresponds to a thickness of the outer panel and the inner panel of the wall, surrounding the window of the door leaf for the rail vehicle.

7. The fixing device according to claim 1, wherein the window profile element includes a recess adjacent to the receiving portion, and wherein the recess provides positive form locking retention of the connection portion of the profile element.

8. The fixing device according to claim 1, wherein the profile element includes a plurality of ribs in the recess portion, wherein the ribs contact the border region of the window pane.

9. A window for a rail vehicle, wherein the window includes the window pane and the fixing device according to claim 1.

10. A method for fixing a window pane of a window in a door leaf for a rail vehicle through the fixing device according to claim 1, the method comprising:

arranging the border region of the window pane in the recess portion of the profile element, wherein the recess portion fits around the border region;

mounting the first part of the fastening device in the mounting portion of the profile element by positive form locking;

arranging the second part of the fastening device in the arrangement portion of the window profile element;

fastening the profile element and the window profile element at one another by positive from locking and/or friction locking through the fastening device; and connecting the cover portion of the profile element at the window profile element by positive form locking, wherein the connection portion of the profile element is received in the receiving portion of the window profile element.

* * * * *